US007343125B2

(12) United States Patent
Miyake

(10) Patent No.: US 7,343,125 B2
(45) Date of Patent: Mar. 11, 2008

(54) IMAGE FORMING APPARATUS

(75) Inventor: Kazunori Miyake, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 308 days.

(21) Appl. No.: 11/296,281

(22) Filed: Dec. 8, 2005

(65) Prior Publication Data

US 2006/0127140 A1 Jun. 15, 2006

(30) Foreign Application Priority Data

Dec. 10, 2004 (JP) ..... 2004-358013

(51) Int. Cl.
*G03G 15/01* (2006.01)

(52) U.S. Cl. ..... 399/299; 399/66

(58) Field of Classification Search ..... 399/66, 399/297, 298, 299, 300, 301, 302, 308
See application file for complete search history.

(56) References Cited

U.S. PATENT DOCUMENTS 5,173,735 A * 12/1992 Kusumoto ..... 399/302
6,427,062 B1 * 7/2002 Takeuchi ..... 399/388
6,990,309 B2 * 1/2006 Kayahara et al. ..... 399/302
7,065,314 B2 * 6/2006 Taguchi ..... 399/298

FOREIGN PATENT DOCUMENTS

JP 6-258914 9/1994
JP 2002-108045 4/2002

* cited by examiner

*Primary Examiner*—Hoan Tran
(74) *Attorney, Agent, or Firm*—Fitzpatrick, Cella, Harper & Scinto

(57) ABSTRACT

An image forming apparatus is operable in a first mode where a toner images on one of a plurality of image bearing members are transferred to an intermediate transfer belt; and in a second mode where toner images on the image bearing members are superimposedly transferred to toner images on the intermediate transfer member. A bias controlling unit controls the bias of the intermediate transfer belt by rotating the intermediate transfer belt until the toner images on the image bearing members are transferred to the intermediate transfer belt after the image bearing members have contacted with or separated from the intermediate transfer belt. A duration when the intermediate transfer belt is rotated when the second mode is changed to the first mode is shorter than a duration when the intermediate transfer belt is rotated when the first mode is changed to the second mode.

6 Claims, 11 Drawing Sheets

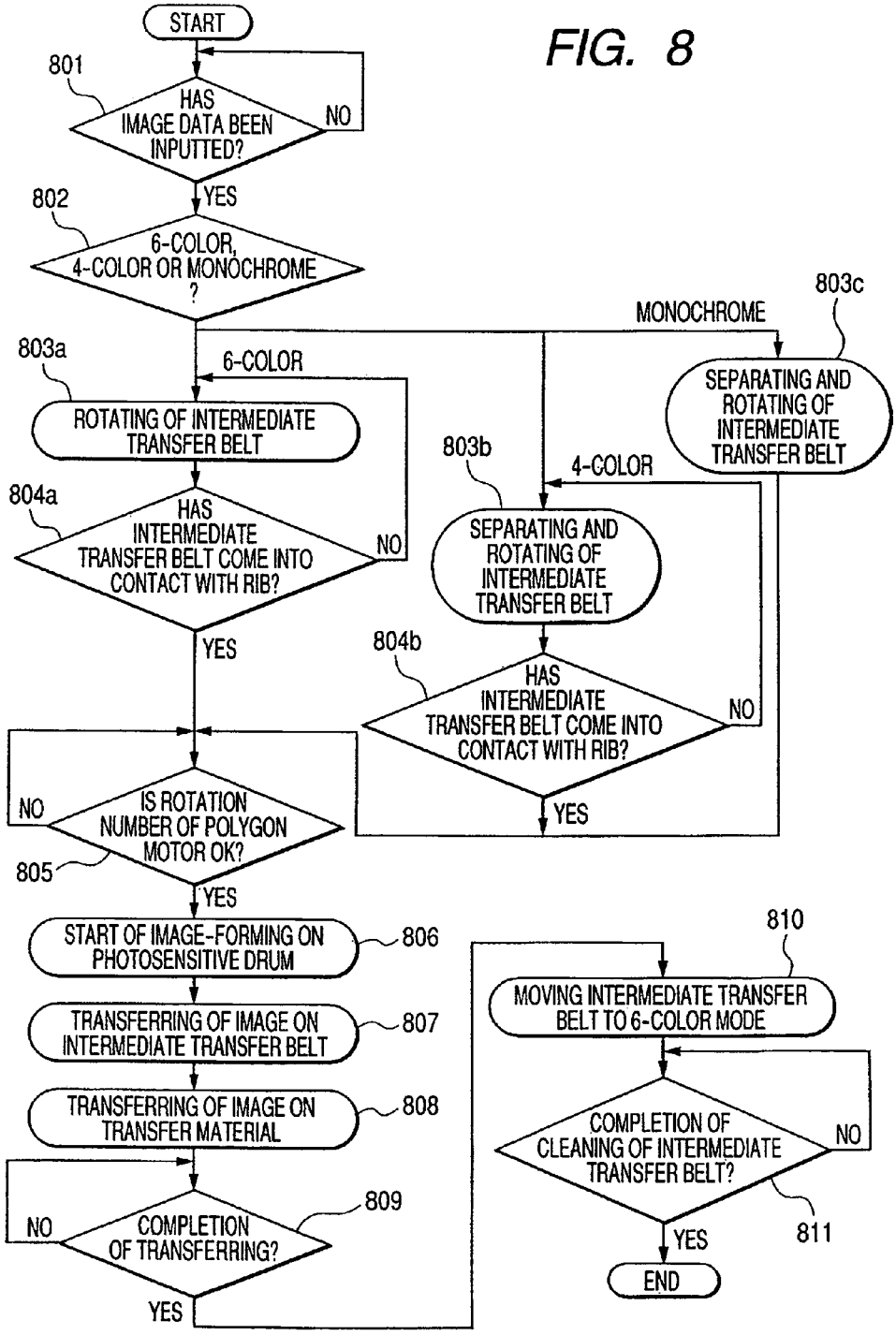
FIG. 8
START
801
HAS IMAGE DATA BEEN INPUTTED?
NO
YES
802
6-COLOR, 4-COLOR OR MONOCHROME ?
MONOCHROME
803c
SEPARATING AND ROTATING OF INTERMEDIATE TRANSFER BELT
803a
6-COLOR
ROTATING OF INTERMEDIATE TRANSFER BELT
803b
4-COLOR
SEPARATING AND ROTATING OF INTERMEDIATE TRANSFER BELT
804a
HAS INTERMEDIATE TRANSFER BELT COME INTO CONTACT WITH RIB?
NO
YES
804b
HAS INTERMEDIATE TRANSFER BELT COME INTO CONTACT WITH RIB?
NO
YES
NO
IS ROTATION NUMBER OF POLYGON MOTOR OK?
805
YES
START OF IMAGE-FORMING ON PHOTOSENSITIVE DRUM
806
TRANSFERRING OF IMAGE ON INTERMEDIATE TRANSFER BELT
807
TRANSFERRING OF IMAGE ON TRANSFER MATERIAL
808
NO
COMPLETION OF TRANSFERRING?
809
YES
810
MOVING INTERMEDIATE TRANSFER BELT TO 6-COLOR MODE
COMPLETION OF CLEANING OF INTERMEDIATE TRANSFER BELT?
NO
YES
811
END

IMAGE FORMING APPARATUS

BACKGROUND OF THE INVENTION

1. Field of the Invention

The present invention relates to an image forming apparatus for forming color images using a plurality of image bearing members and an intermediate transfer belt or a transfer material conveying belt, and in particular, to such apparatus in which, in a color image formation, a plurality of image bearing members are in touch with the above belt, and in which, in a monochrome image formation, image bearing members not concerned with image formation are separated from the belt.

2. Related Background Art

In recent years, there has been an increasing demand for longer service life in image forming apparatus based on electrophotographic system. In an image forming apparatus disclosed in Japanese Patent Application Laid-Open No. H6-258914, four image bearing members are in touch with an intermediate transfer belt in a color-image formation mode. On the other hand, in a monochrome-image formation mode, image bearing members-on which toner images in color rather than in black are formed are separated from the intermediate transfer belt.

Similarly, in the image forming apparatus disclosed in Japanese Patent Application Laid-Open No. 2002-108045, four image bearing members are in touch with a transfer material conveying belt in a color-image formation mode. On the other hand, in a monochrome-image formation mode, image bearing members on which toner images in color rather than in black are formed are separated from the transfer material conveying belt. In both image forming apparatuses mentioned above, image bearing members not in use are separated from the intermediate transfer belt and the transfer material conveying belt in the monochrome image formation mode to extend a service life of the image bearing members.

In the aforementioned image forming apparatus, however, switching of the image formation modes changes the number of image bearing members in contact with the intermediate transfer belt and the transfer material conveying belt. Change in the number of image bearing members in contact with them influences bias when the intermediate transfer and transfer material conveying belts are rotated. For this reason, bias needs controlling until the toner images on the image bearing members are transferred to the transfer material borne by the intermediate transfer belt or the transfer material conveying belt after a mode has been switched. The control of bias requires the time during which images cannot be formed, causing a problem in that productivity in image forming apparatus falls.

SUMMARY OF THE INVENTION

An object of the present invention is to suppress the decrease in productivity for the image forming apparatus in which in the color-image formation mode a plurality of image bearing members are in touch with the above belt, and in which in the monochrome-image formation mode image bearing members not concerned with image formation are separated from the belt.

Another object of the present invention is to provide an image forming apparatus having:

a plurality of image bearing members for bearing toner images;

an intermediate transfer belt to which the toner images on the image bearing members are transferred;

contacting and separating means for causing the image bearing members to be in contact with and separated from the intermediate transfer belt;

a first image forming mode where one of the plurality of image bearing members is in contact with the intermediate transfer belt and where toner images on the image bearing members are transferred to the intermediate transfer belt;

a second image forming mode where the plurality of image bearing members are in contact with the intermediate transfer belt and where toner images on the image bearing members are superimposedly transferred to toner images on the intermediate transfer belt;

switching means for causing the image bearing members to be into contact with and separated from the intermediate transfer belt to switch the image forming modes; and bias controlling means for controlling the bias of the intermediate transfer belt by rotating the intermediate transfer belt until the toner images on the image bearing members are transferred to the intermediate transfer belt after the image bearing members have been caused to be in contact with or separated from the intermediate transfer belt, wherein a duration when the intermediate transfer belt is rotated by the bias controlling means when the second image forming mode is changed to the first image forming mode is shorter than a duration when the intermediate transfer belt is rotated by the bias controlling means when the first image forming mode is changed to the second image forming mode.

Further, another object of the present invention is to provide an image forming apparatus having:

a plurality of image bearing members for bearing toner images;

a transfer material conveying belt for conveying transfer material;

transferring means for transferring the toner images on the image bearing members to the transfer material;

contacting and separating means for causing the image bearing members to be in contact with and separated from the transfer material conveying belt;

a first image forming mode where one of the plurality of image bearing members is in contact with the transfer material conveying belt and where the toner images on the image bearing members are transferred to the transfer material conveyed by the transfer material conveying belt;

a second image forming mode where the plurality of image bearing members are in contact with the transfer material conveying belt and where the toner images on the image bearing members are superimposedly transferred to the toner images on the transfer material;

switching means for causing the image bearing members to be in contact with and separated from a recording material conveying member to switch the image forming modes;

bias controlling means for controlling the bias of the transfer material conveying belt by rotating the transfer material conveying belt until the toner images on the image bearing members are transferred to the transfer material after the image bearing members have been caused to be in contact with or separated from the transfer material conveying belt, wherein a duration when the transfer material conveying belt is rotated by the bias controlling means when the second image forming mode is changed to the first image forming mode is shorter than a duration when the transfer material conveying belt is rotated by the bias controlling means when the first image forming mode is changed to the second image forming mode.

BRIEF DESCRIPTION OF THE DRAWINGS

FIG. 8 shows a flow chart in an image forming operation according to a second embodiment.

DESCRIPTION OF THE PREFERRED EMBODIMENTS

In the present invention, a rotation time of the intermediate transfer belt and the transfer material conveying belt rotated by bias controlling means when a color image forming mode (a second image forming mode) is changed to a monochrome image forming mode (a first image forming mode) is shortened compared to that of the intermediate transfer belt and the transfer material conveying belt rotated by bias controlling means when a monochrome image forming mode (a first image forming mode) is changed to a color image forming mode (a second image forming mode), thereby enabling suppressing reduction in productivity.

The embodiment of the present invention is described in detail below.

First Embodiment

Figure 1:
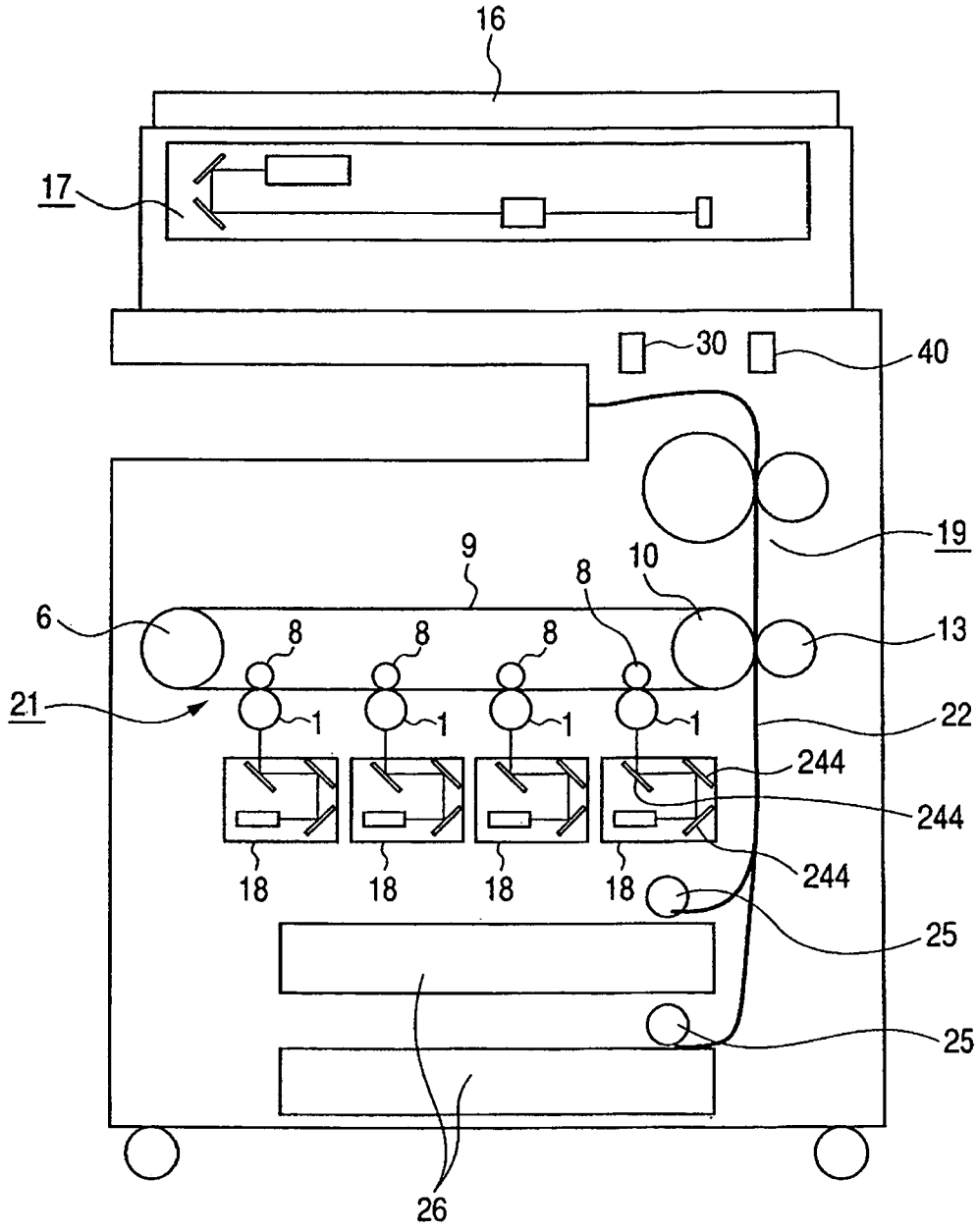
FIG. 1 shows a block diagram of an image forming apparatus according to a first embodiment.
Figure 2A:
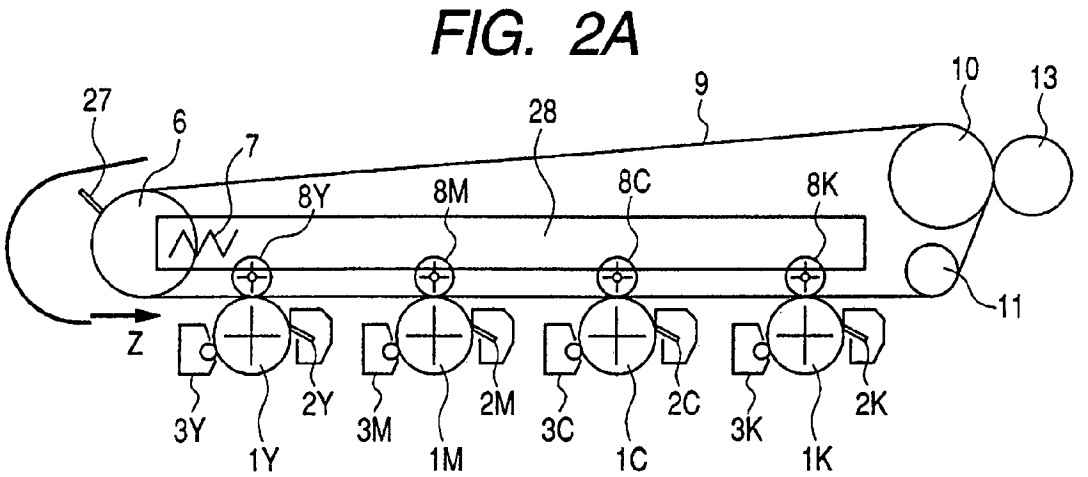
FIGS. 2A and 2B show block diagrams in the vicinity of an image bearing member and intermediate transfer belt.
Figure 2B:
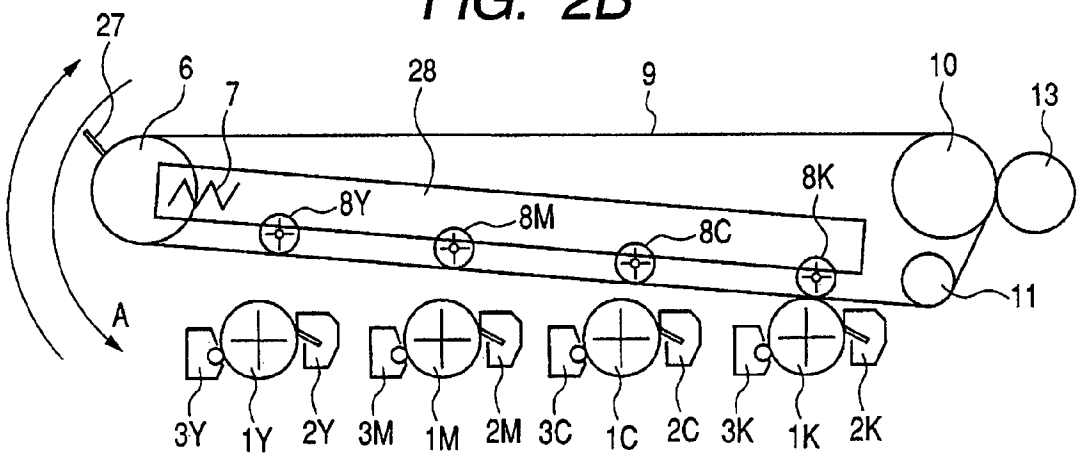

The first embodiment of the image forming apparatus according to the present invention is described with reference to the drawings. FIG. 1 shows a block diagram of the image forming apparatus according to the present embodiment. FIGS. 2A and 2B show enlarged block diagrams depicting the parts of the image bearing members and the intermediate transfer unit 21. FIG. 2A shows a case where all four-color images are formed (a color mode being a plural color image forming mode). FIG. 2B shows a case where only a black image is formed (a monochrome mode being a monochrome image forming mode). The subscripts (Y, M, C and K) to the reference characters denote yellow, magenta, cyan and black respectively to be affixed to the elements.

(Configuration of a Full Color Copier)

Figure 9:
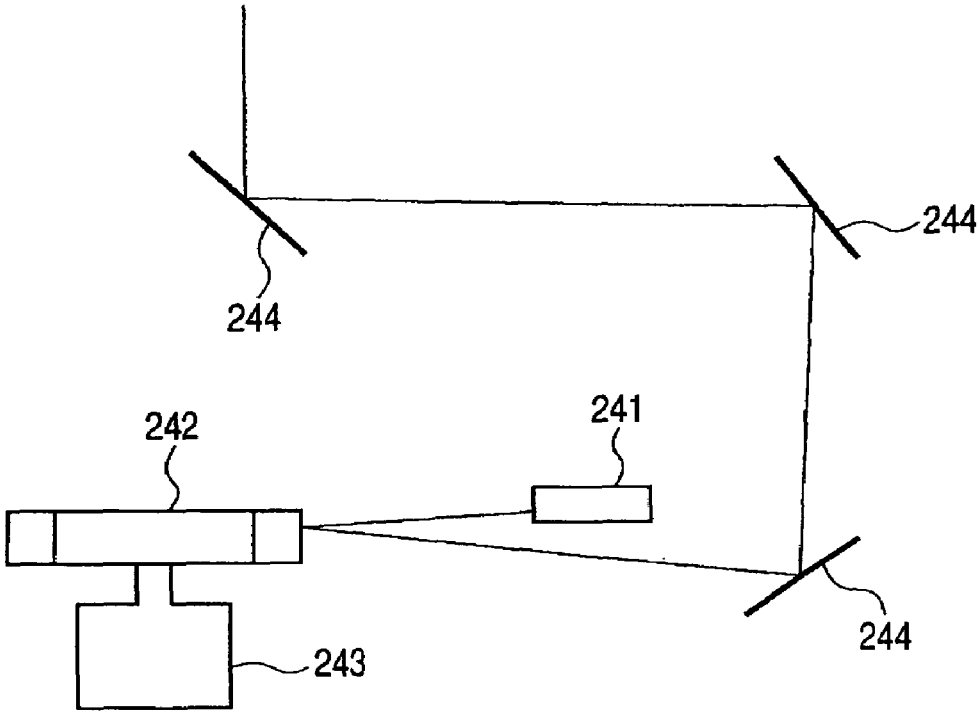
FIG. 9 shows the details of a laser scanner unit.

First, a configuration of a full color copier using electrophotography as one example of an image forming apparatus is described in brief. As shown in FIGS. 1 and 2, the full color copier is basically provided with a photosensitive drum 1 being an image bearing member, cleaning unit 2, developing unit (developing means) 3, outer transfer roller 13, original glass plate 16, reader unit 17, laser scanner unit (electrostatic image forming means) 18, fixing unit 19, intermediate transfer unit 21, feeding roller 25, and feeding cassette 26. The details of the laser scanner unit 18 are shown in FIG. 9. Light beams radiated from a laser emitting unit 241 are scanned with a rotating polygon mirror 242 and irradiated on the photosensitive drum 1 through a reflecting mirrors 244. The polygon mirror 242 is rotated by a polygon motor (driving source) 243.

The full color copier has-a plurality of image forming modes, i.e., monochrome and color modes, being different in the number of photosensitive drums 1 according to image formation.

The intermediate transfer unit 21 is composed of a tension roller 6, tension spring 7, transfer driving roller 10, idler roller 11, transfer roller 8, intermediate transfer belt 9 and transfer frame 28 being contacting and separating means.

The transfer driving roller 10 and idler roller 11 are fixed to a body frame (not shown). The tension roller 6, tension spring 7, and transfer rollers 8K, 8C, 8M and 8Y are supported by the transfer frame 28. The transfer frame 28 is rotationally movable about the transfer roller 8K.

As shown in FIG. 2A, all photosensitive drums 1C, 1M, 1Y and 1K concerned with the formation of color images are in contact with the intermediate transfer belt 9 in the color mode being the plural color image forming mode where a plurality of the photosensitive drums 1 are concerned. As shown in FIG. 2B, on the other hand, only the photosensitive drum 1K is in contact with the intermediate transfer belt 9 in the monochrome mode being the monochrome image forming mode where a singular photosensitive drum 1 is concerned, so that the photosensitive drums 1C, 1M and 1Y not concerned with image formation are separated from the intermediate transfer belt 9. Switching the color mode to the monochrome and vice versa is conduced by switching means 30.

(Alignment Correction of the Intermediate Transfer Belt 9)

Figure 3A:
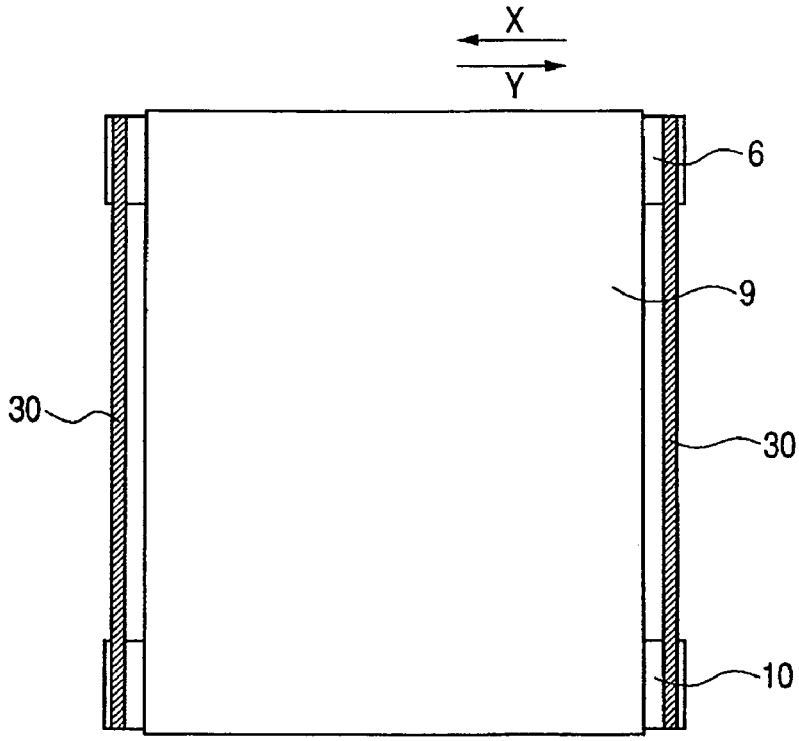
FIGS. 3A and 3B show top views of the intermediate transfer unit.
Figure 3B:
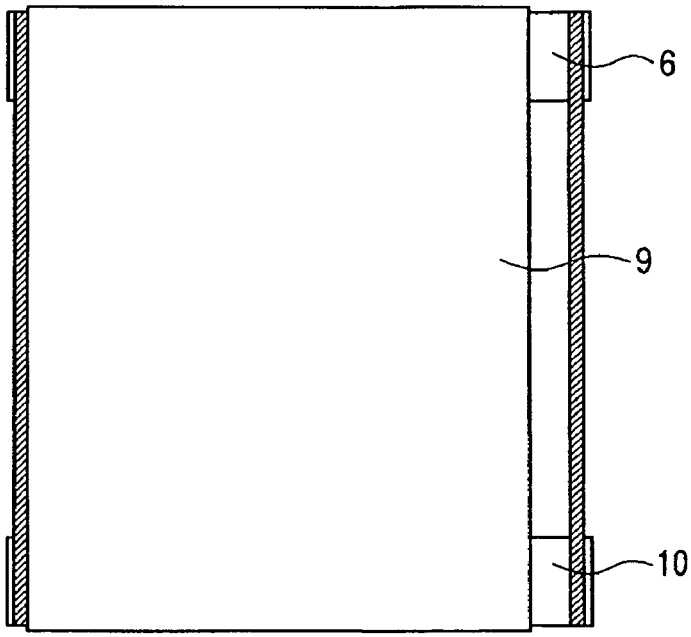

The following is a description on bias control of the intermediate transfer belt 9 (alignment correction of the intermediate transfer belt 9) following the rotational movement of the transfer frame 28. FIGS. 3A and 3B show top views of the intermediate transfer unit 21. The tension roller 6 and transfer driving roller 10 are formed to move the intermediate transfer belt 9 to a rib 30 while the intermediate transfer belt 9 rotates. For example, the tension roller 6 and transfer driving roller 10 may be tapered to move the intermediate transfer belt 9 toward the rib 30. This enables correction of alignment of the intermediate transfer belt 9 with respect to the rib 30 only by rotating the intermediate transfer belt 9.

As shown in FIG. 3A, suppose that the intermediate transfer belt 9 lies at the center of the ribs 30 provided at both sides of the belt in the direction of its width. When the monochrome mode is changed to the color mode, the transfer frame 28 is rotatably moved toward the arrow A shown in FIG. 2B, which changes the mode to the color mode where the four photosensitive drums 1C, 1M, 1Y and 1K are in contact with the intermediate transfer belt 9 as shown in FIG. 2A. Where, the perimeter of the intermediate transfer belt 9 is 720 mm. The intermediate transfer belt 9 is rotated by the transfer driving roller 10 at a speed of 144 mm/sec. The intermediate transfer belt 9 takes five seconds for one complete cycle.

During rotation the alignment of the tension roller 6 deviates. The intermediate transfer belt 9 rotates toward the arrow Z shown in FIG. 2A with the alignment of the tension roller deviating. That causes the intermediate transfer belt 9 to move toward the width of the belt (in the direction of the arrow X or the arrow Y), resultantly, to touch the rib 30 provided on the transfer frame 28. For example, as shown in FIG. 3B, the intermediate transfer belt 9 moves toward the arrow X and touch the rib 30. Images are not formed until the intermediate transfer belt 9 touches the rib 30 (in the state where alignment has been completed). In the present embodiment, bias control is conducted by rotating the intermediate transfer belt 9 until the end of the intermediate transfer belt 9 touches the rib 30.

(Image Forming Operation)

The following is a description on how the full color copier having the aforementioned configuration forms images.

Figure 4:
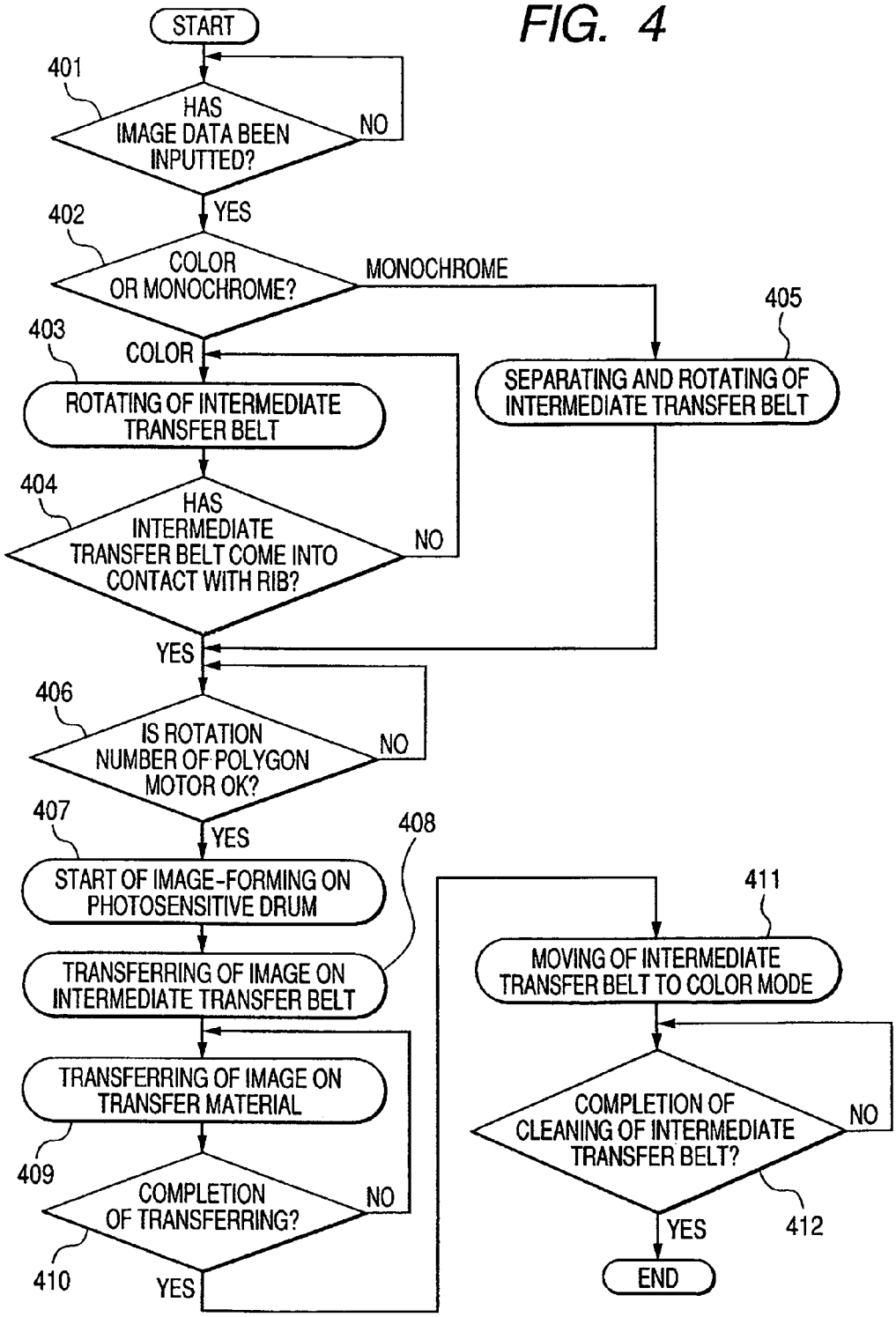
FIG. 4 shows a flow chart in an image forming operation.

FIG. 4 shows a flow chart in an image forming operation. As shown in FIG. 4, an original document placed on the original glass plate 16 is optically read with a reader unit 17, image data is transmitted to laser scanner unit 18, (i.e., the image data is inputted into the image forming apparatus) (Step 401), and then determination is made whether the image data is a monochrome or color image (Step 402).

When the image data is a color image, the intermediate transfer belt 9, photosensitive drums 1, and polygon motor 243 for rotating the polygon mirror 244 are started to be driven (Step 403). At this point, the intermediate transfer belt 9 is rotated until the intermediate transfer belt 9 touches the rib 30 to correct alignment of the intermediate transfer belt 9, because the color mode will cause color shift due to deviation in alignment (Step 404).

When the image data is a monochrome image (monochrome mode), the intermediate transfer belt 9 is separated from the drums while the intermediate transfer belt 9, photosensitive drum 1 and polygon motor (not shown) are started to be driven (Step 405). At this point, however, the monochrome mode will not cause color shift even if alignment deviates, so that the alignment of the intermediate transfer belt 9 is corrected in a shorter time than that in the color mode.

Determination is made whether the polygon motor reaches a predetermined rotation number after the intermediate transfer belt 9 has touched the rib 30 in the color mode, and after the intermediate transfer belt 9 has been separated from the drums in the monochrome mode (Step 406).

When the predetermined rotation number has been reached, the laser scanner unit 18 scans laser beams from the laser emitting unit 241 with the polygon mirror 242 based on image signals, leads them to the optical path via several optical lenses (not shown) with the reflecting mirror 244, and irradiates them on photosensitive drums 1.

Rotation of the photosensitive drums 1 in synchronization with the image signals read by the reader unit 17 causes the scanned laser beams from the laser scanner unit 18 to form a latent image on the photosensitive drums 1 (Step 407).

The latent images formed on the photosensitive drums 1 are visualized (development) using toner by the developing unit 3 being developing means. The visualized images are transferred to the intermediate transfer belt 9 being an endless belt by the transfer roller 8 (Step 408).

In the monochrome mode, the above operation is conducted only for black. In the color mode, on the other hand, the above processes are repeated continuously for each of the colors; yellow, cyan, magenta and black. According as the intermediate transfer belt 9 moves in the direction of the arrow Z with a process speed kept, toner images of each color are sequentially and superimposedly transferred to the intermediate transfer belt 9.

A transferring sheet (not shown) being a transferring material is loaded onto the feeding cassette 26. The transferring sheet is picked up by the feeding roller 25 and conveyed along a transferring-sheet conveying path 22 by a plurality of conveying rollers (not shown). The toner images of respective colors transferred to the intermediate transfer belt 9 are transferred to the transferring sheet in the nip between the transfer driving roller 10 and the outer transfer roller 13 (Step 409). After that, the fixing unit 19 applies heat and pressure to the toner images of respective colors to fix them on the transferring sheet and then the sheet is ejected.

When the transfer of the toner images to the transferring sheet is completed (Step 410), cleaning the photosensitive drums 1 and the intermediate transfer belt 9 is started. During the cleaning time the intermediate transfer belt 9 is always moved to the color mode (Step 411). That is to say, when images are formed in the monochrome mode, the intermediate transfer belt 9 is moved to come into contact with the photosensitive drums 1. When images are formed in the color mode, the intermediate transfer belt 9 is kept being into contact with the photosensitive drums 1.

Toner left on the photosensitive drums 1 is collected with cleaning units 2 to clean the photosensitive drums 1. Toner left on the intermediate transfer belt 9 is collected with an intermediate transfer belt cleaner 27 to clean the intermediate transfer belt 9. As soon as cleaning the intermediate transfer belt 9 has been finished, a printing job terminates (Step 412).

(Timing for Correcting the Alignment of the Intermediate Transfer Belt 9)

Figure 5A:
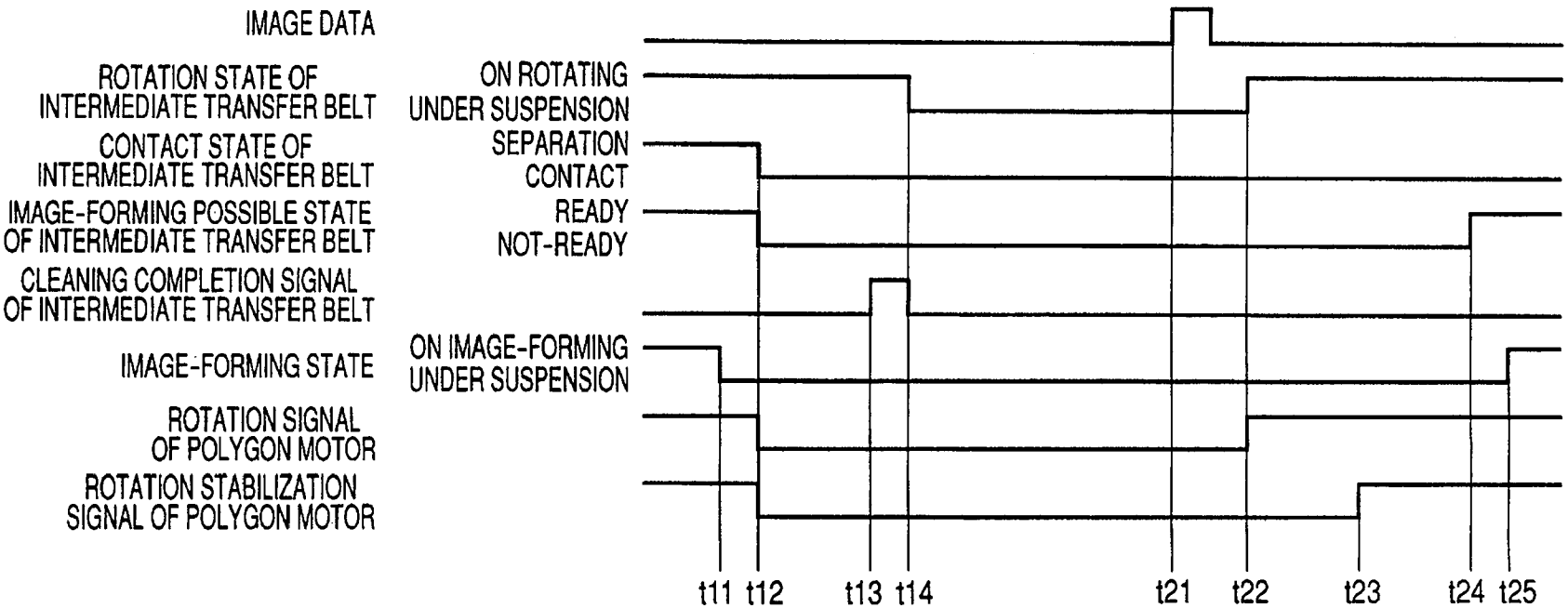
FIG. 5A shows a timing chart in which a monochrome mode is changed to a color mode.

FIG. 5A shows a timing chart in which printing is performed in the monochrome mode in a previous job and subsequently in the color mode in the following job. As shown in FIG. 5A, when image formation in the previous job is completed (t11), the polygon motor is stopped, and the intermediate transfer belt 9 in the monochrome mode is started to be moved to the color mode (t12). The intermediate transfer belt 9 keeps rotating to remove residue toner left on the intermediate transfer belt 9 that has failed to be transferred completely to the transferring sheet by the intermediate transfer belt cleaner 27. After a cleaning time has elapsed, the intermediate transfer belt 9 is stopped according to a signal informing of completion of cleaning the intermediate transfer belt 9 (t13), and printing job is finished (t14).

An image signal for the following job is received (t21), the intermediate transfer belt 9 and the polygon motor are started to be rotated (t22), and determination is made whether the image signal is color or monochrome. Bias control is so performed that image formation is started in the color mode (the toner images on the photosensitive drums 1 are transferred to the intermediate transfer belt 9) (t25) after the rotating speed of the polygon motor has been stabilized (t23), after alignment correction of the intermediate transfer belt 9 has been completed (t24), and after a waiting time before image formation has elapsed.

As described above, the intermediate transfer belt 9 is kept coming into contact with all the photosensitive drums 1C, 1M, 1Y and 1K concerned with the formation of color images by the transfer frame 28 during a cleaning time (t11 to t13) when the intermediate transfer belt 9 is cleaned after the formation of images. When color images are formed after monochrome ones have been formed, alignment of the intermediate transfer belt 9 is corrected during a waiting time (t21 to t23) until the following image formation starts after the cleaning time has elapsed (interval during which the rotating speed of the polygon motor is stabilized).

That allows service life of photosensitive drums 1 and the intermediate transfer belt 9 to be extended, and color shift and color shading on the color images to be suppressed. Further, that eliminates the need for sparing time to correct the alignment of the intermediate transfer belt 9 separately, reducing downtime required until images can be formed and decrease in productivity.

It takes 30 seconds between "t12" when the intermediate transfer belt 9 comes into contact with or is separated from the drums and "t25" when images are started to be formed (transferring toner image from the intermediate transfer belt 9 to photosensitive drums 1), during which the intermediate transfer belt 9 is rotating. The intermediate transfer belt 9 makes six complete cycles for 30 seconds.

Figure 5B:
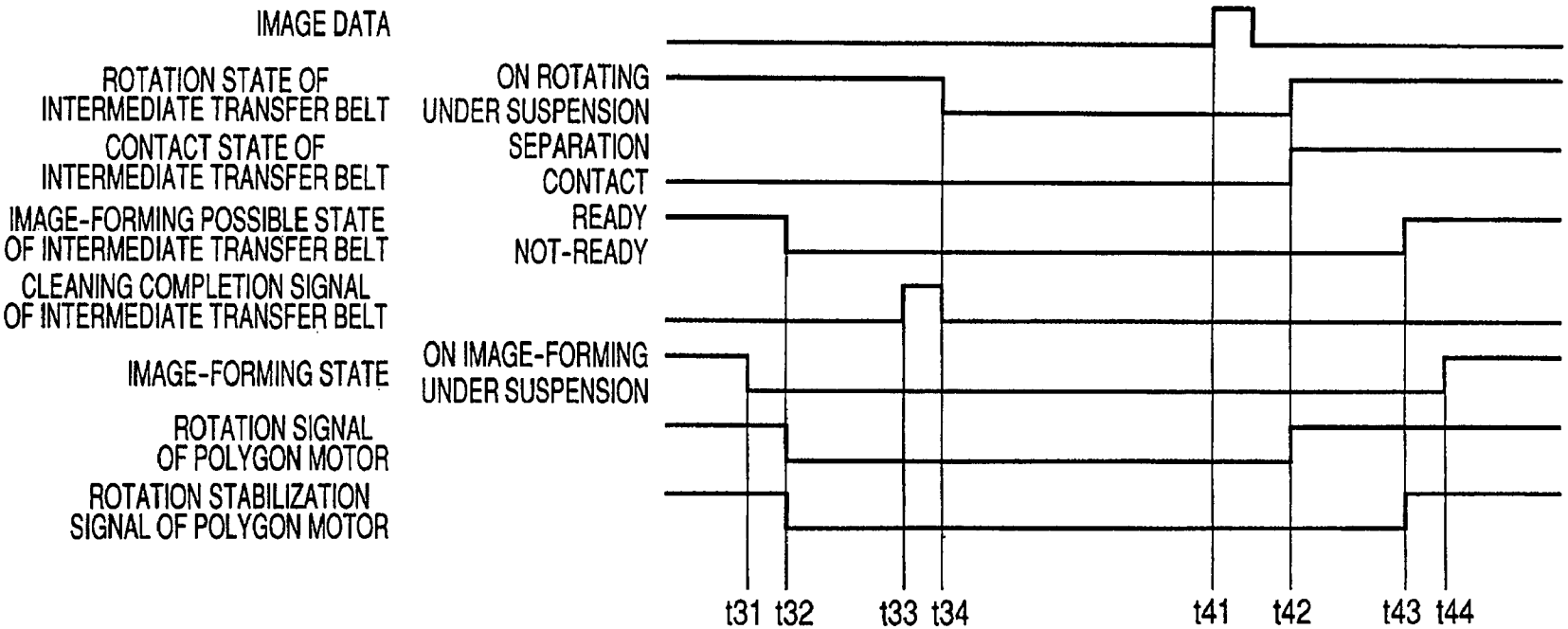
FIG. 5B shows a timing chart in which a color mode is changed to a monochrome mode.

FIG. 5B shows a timing chart in which printing is performed in the color mode in a previous job, and subsequently in the monochrome mode in the following job. As shown in FIG. 5B, when image formation in the previous job is completed (t31), the polygon motor is stopped (t32). At this point, the intermediate transfer belt 9 keeps the color mode. The intermediate transfer belt 9 keeps rotating to remove residue toner left on the intermediate transfer belt 9 that has failed to be transferred completely to the transferring sheet by the intermediate transfer belt cleaner 27. After a cleaning time has elapsed, the intermediate transfer belt 9 is stopped according to a signal informing of completion of cleaning the intermediate transfer belt 9 (t33), and printing job is finished (t34).

An image signal for the following job is received (t41), the intermediate transfer belt 9 and the polygon motor are started to be rotated (t42), and determination is made whether the image signal is color or monochrome. The intermediate transfer belt 9 is started to be changed to the monochrome mode (t42) because the image is monochrome in this case. Image formation is started in the monochrome mode (t44) after the rotating speed of the polygon motor has been stabilized (t43) and after a waiting time before image formation has elapsed.

It takes five seconds between "t42" when the intermediate transfer belt 9 comes into contact with or is separated from the drums and "t44" when images are started to be formed (transferring toner image from the intermediate transfer belt 9 to photosensitive drums 1), during which the intermediate transfer belt 9 is rotating. The intermediate transfer belt 9 makes one complete cycle for five seconds.

Since the mode is monochrome in this case, color shift is not caused even if alignment of the tension roller 6 deviates. This enables image formation without the correction of alignment of the intermediate transfer belt 9, thereby allows cleaning time and waiting time to be shortened when monochrome images are formed after color images has been formed (in switching a plural color image forming mode to a monochrome image forming mode), reducing downtime required until images can be formed and decrease in productivity.

Figure 6A:
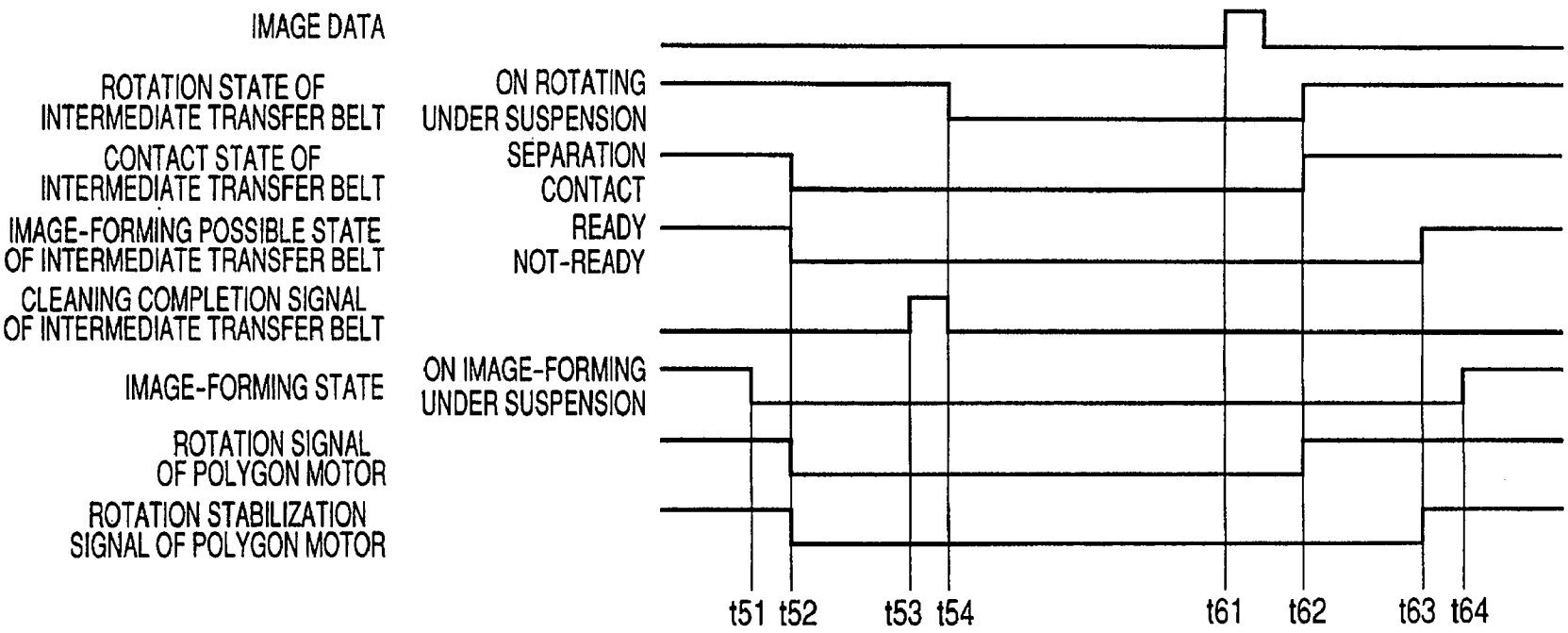
FIG. 6A shows a timing chart in which a monochrome is kept without changing a color mode.

FIG. 6A shows a timing chart in which printing is performed in the monochrome mode in a previous job and also in the monochrome mode in the following job. As shown in FIG. 6A, when image formation in the previous job is completed (t51), the polygon motor is stopped, and the intermediate transfer belt 9 in the monochrome mode is started to be moved to the color mode (t52). The intermediate transfer belt 9 keeps rotating to remove residue toner left on the intermediate transfer belt 9 that has failed to be transferred completely to the transferring sheet by the intermediate transfer belt cleaner 27. After a predetermined time has elapsed, the intermediate transfer belt 9 is stopped to be driven according to a signal informing of completion of cleaning the intermediate transfer belt 9 (t53), and printing job is finished (t54).

An image signal for the following job is received (t61), the intermediate transfer belt 9 and the polygon motor are started to be rotated (t62), and determination is made whether the image signal is color or monochrome. The intermediate transfer belt 9 is started to be changed to the monochrome mode (t62) because the image is monochrome in this case. Image formation is started in the monochrome mode (t64) after the rotating speed of the polygon motor has been stabilized (t63) and after a waiting time before image formation has elapsed.

Since the mode is monochrome in this case, color shift is not caused even if alignment of the tension roller 6 deviates. This enables image formation without the correction of alignment of the intermediate transfer belt 9, thereby allows cleaning time and waiting time to be shortened when monochrome images are formed after color images has been formed (in switching a monochrome color image forming mode to a monochrome image forming mode), reducing downtime required until images can be formed and decrease in productivity.

Figure 6B:
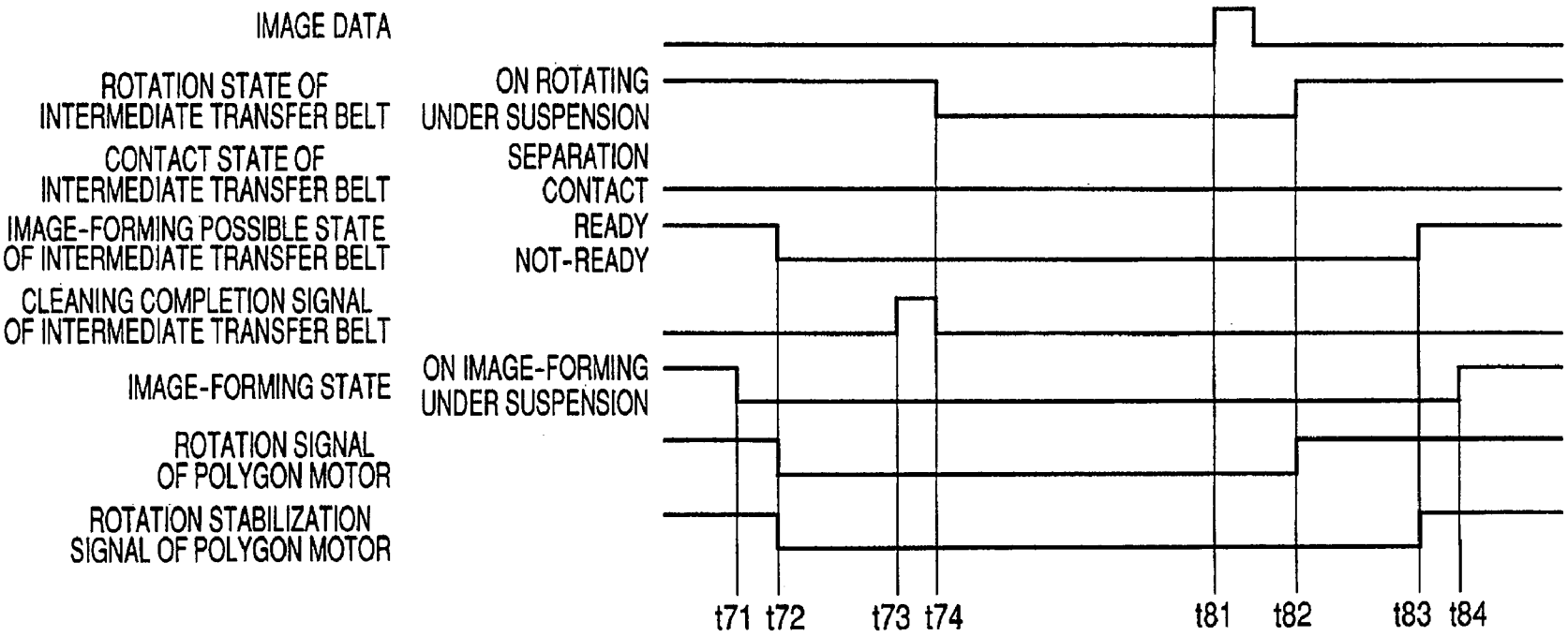
FIG. 6B shows a timing chart in which a color mode is kept without changing to a monochrome mode.

FIG. 6B shows a timing chart in which printing is performed in the color mode in a previous job and also in the color mode in the following job. As shown in FIG. 6B, when image formation in the previous job is completed (t71), the polygon motor is stopped (t72). At this point, the intermediate transfer belt 9 keeps the color mode without operating the transfer frame 28. The intermediate transfer belt 9 keeps rotating to remove residue toner left on the intermediate transfer belt 9 that has failed to be transferred completely on the transferring sheet by the intermediate transfer belt cleaner 27. After a cleaning time has elapsed, the intermediate transfer belt 9 is stopped to be driven according to a signal informing of completion of cleaning the intermediate transfer belt 9 (t73), and printing job is finished (t74).

An image signal for the following job is received (t81), the intermediate transfer belt 9 and the polygon motor are started to be rotated (t82), and determination is made whether the image signal is color or monochrome. Image formation is started in the color mode (t84) after the rotating speed of the polygon motor has been stabilized (t83) and after a waiting time before image formation has elapsed.

In this case the mode for the intermediate transfer belt 9 is not changed. The alignment of the tension roller 6 will not deviate. This enables image formation without correcting the alignment of the intermediate transfer belt 9, thereby allows cleaning time and waiting time to be shortened when color images are formed after color images has been formed (in switching plural color image forming mode to plural color image forming mode), reducing downtime required until images can be formed and decrease in productivity.

The present invention is not limited to the image forming apparatus based on the intermediate transfer belt system using an intermediate transfer belt. The present invention can be applied to an image forming apparatus based on a direct transfer belt system using a transfer material conveying belt (endless belt) for conveying transfer materials to which developer images of each color formed on photosensitive drums 1 are transferred. In this case, the alignment of the intermediate transfer belt 9 is corrected in a cleaning time of the photosensitive drums 1 instead of that of the intermediate transfer belt 9.

In the present embodiment, it is stated that the alignment of the intermediate transfer belt 9 should be corrected in a waiting time (interval when the rotating speed of the polygon motor is stabilized) (t21 to t23), however, the alignment of the intermediate transfer belt 9 may be corrected in the cleaning time.

The configuration of the full color copier as an image forming apparatus has been described in the present invention, however the present invention is not limited to a copier. The present invention is effective for apparatus for forming images by electrophotographic process, such as full color printer and full color fax machine.

The scope of the present invention is not limited by an optical scanning reading system, laser-beam scanning writing-system and fixing system for fixing images by heat and pressure. The present invention can be applied to any means, for example, a reading system operated by an area sensor in which photodetectors are arranged in two dimensions, LED writing system and flash exposure fixing system.

The image forming apparatus is so configured that in the color mode the photosensitive drums 1C, 1M, 1Y and 1K come into contact with the intermediate transfer belt 9 and in the monochrome mode, however, only the photosensitive drum. 1K comes into contact with the intermediate transfer belt 9. The present invention, however, is not only limited to the image forming apparatus with above configuration, but also applicable to apparatus provided with a photosensitive drum concerned with image formation only in special colors such as transparent, light magenta and others. The photosensitive drums used only for image formation in such colors are adapted not to come into contact with the intermediate transfer belt 9 when color and monochrome images are formed.

For example, in the monochrome mode, only the photosensitive drum 1K is in contact with the intermediate transfer belt 9. In the color mode, all photosensitive drums 1C, 1M, 1Y and 1K concerned with color image formation are in contact with the intermediate transfer belt 9. In the special color mode, all photosensitive drums concerned with image formation in special colors are in contact with the intermediate transfer belt 9.

Other Embodiment

The other embodiment of an image forming apparatus according to the present invention is described below with reference to the drawings. Descriptions overlapping with those in the aforementioned first embodiment are omitted and given the same reference characters instead. The image forming apparatus according to the present embodiment includes the photosensitive drums 1LM and 1LC with special two colors; light magenta and light cyan in addition to four colors; yellow, magenta, cyan and black in the above first embodiment. Moreover, the apparatus has six color modes as a plural color image formation mode with which six-color photosensitive drums 1 are concerned, in addition to four color modes being the color mode mentioned in the first embodiment.

Figure 7A:
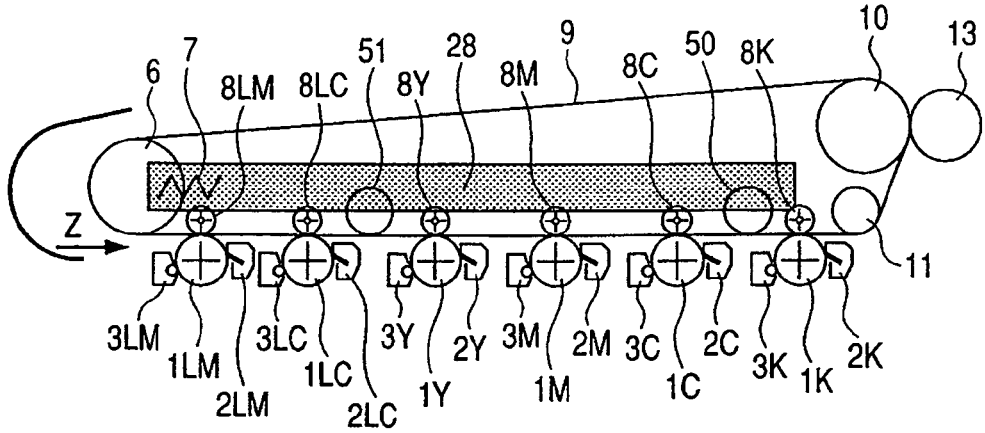
FIGS. 7A, 7B and 7C show block diagrams in the vicinity of the image bearing member and the intermediate transfer belt according to a second embodiment.
Figure 7B:
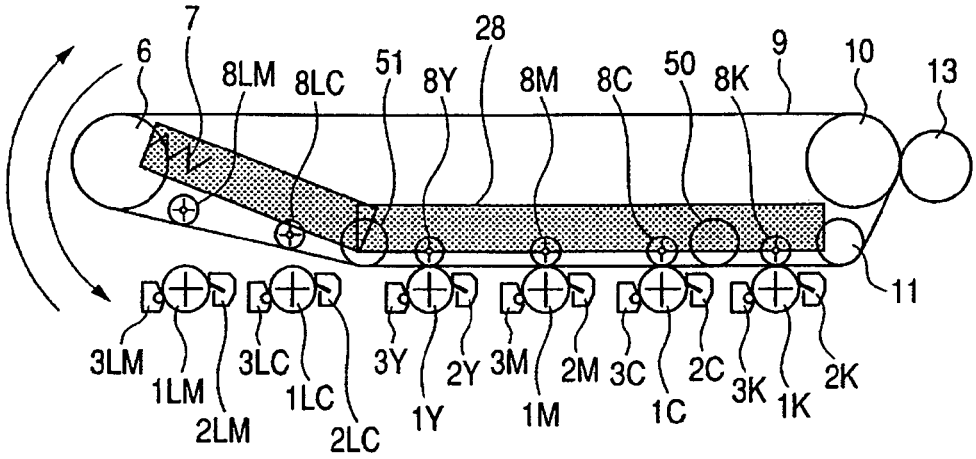
Figure 7C:
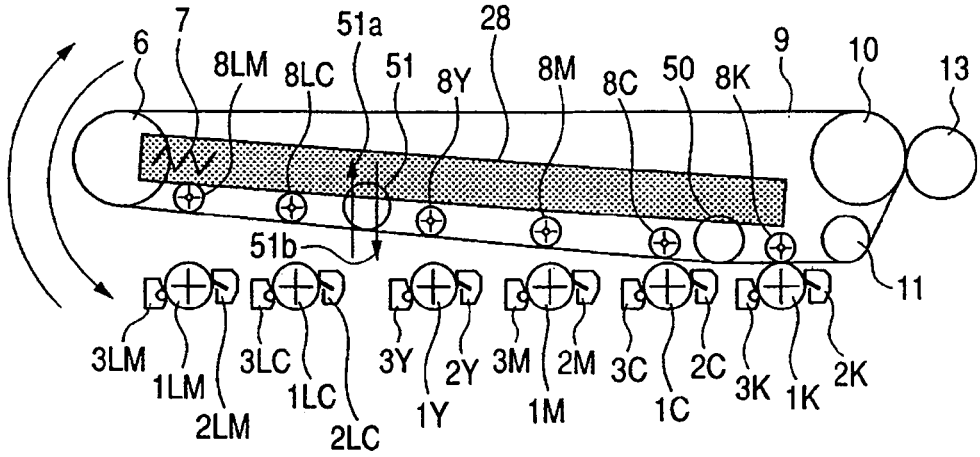

FIGS. 7A, 7B and 7C show block diagrams in the vicinity of the image bearing members and intermediate transfer belt according to the present embodiment. An intermediate transfer unit 21 is composed of a tension roller 6, tension spring 7, transfer driving roller 10, idler roller 11, transfer roller 8, intermediate transfer belt 9, and transfer frame 28 being contacting and separating means. In FIGS. 7A, 7B and 7C, the subscripts (Y, M, C, K, LM and LC) to each reference character denote yellow, magenta, cyan, black, light magenta and light cyan respectively to be affixed to the elements.

The transfer driving roller 10 and idler roller 11 are fixed to the frame of the body (not shown). The tension roller 6, tension spring 7 and transfer rollers 8K, 8C, 8M and 8Y are supported by the transfer frame 28. The transfer frame 28 is rotationally movable about the transfer rollers 50 and 51.

As shown in FIG. 7A, in the six modes, all the photosensitive drums 1C, 1M, 1Y, 1K, 1LM and 1LC are in contact with the intermediate transfer belt 9. As shown in FIG. 7B, in the four modes, the photosensitive drums 1C, 1M, 1Y and 1K are in contact with the intermediate transfer belt 9 and the photosensitive drums 1LM and 1LC not concerned with image formation are separated from the intermediate transfer belt 9. As shown in FIG. 7C, in the monochrome mode, only the photosensitive drum 1K is in contact with the intermediate transfer belt 9 and the photosensitive drums 1C, 1M, 1Y, 1LM and 1LC not concerned with image formation are separated from the intermediate transfer belt 9.

FIG. 8 shows a flow chart in an image forming operation according to another embodiment. As shown in FIG. 8, an original document placed on the original glass plate 16 is optically read by the reader unit 17, image data is then transmitted to the laser scanner unit 18 (the image data is inputted into the image forming apparatus) (Step 801), and the output modes are selected from among six color, four color and monochrome (Step 802).

When the output image in photo quality (the six-color mode) is selected, the intermediate transfer belt 9, photosensitive drums 1 and polygon motor (not shown) are started to be driven (Step 803*a*). At this point, since color shift is caused due to the six-color mode, the intermediate transfer belt 9 is rotated until the intermediate transfer belt 9 touches the rib 30 to correct the alignment of the intermediate transfer belt 9 (Step 804*a*).

Similarly, when the output image in standard picture quality (four-color mode) is selected, the intermediate transfer belt 9, photosensitive drums 1 and polygon motor (not shown) are started to be driven (Step 803*b*). At this point, since color shift is caused due to the four-color mode, the intermediate transfer belt 9 is rotated until the intermediate transfer belt 9 touches the rib 30 to correct the alignment of the intermediate transfer belt 9 (Step 804*b*).

In the monochrome image (monochrome mode), the intermediate transfer belt 9, the photosensitive drums 1, and polygon motor (not shown) are started to be driven and the intermediate transfer belt 9 is separated (803*c*). No color shift is caused because of the monochrome mode, therefore the time during which the alignment of the intermediate transfer belt 9 is corrected is shorter than that in the six- and four-color modes. When a mode is switched from the other modes to the monochrome, it takes six seconds until image formation is started after the intermediate transfer belt 9 has been separated from the photosensitive drums 1, during which the intermediate transfer belt 9 is rotating. The intermediate transfer belt 9 makes one complete cycle for six seconds.

When the other modes are switched to the four-color mode, or when the other modes are switched to the six-color mode, it takes 30 seconds until image formation is started after the intermediate transfer belt 9 has been in contact with and away from the photosensitive drums 1, during which the intermediate transfer belt 9 is rotating. The intermediate transfer belt 9 makes six complete cycles for 30 seconds.

Determination is made whether the rotation number of the polygon motor reaches a predetermined rotation number required for image formation after the intermediate transfer belt 9 has touched the rib 30 in the six and four color modes and after the intermediate transfer belt 9 has been separated from the drums in the monochrome mode (Step 805).

When the predetermined rotation number has been reached, the laser scanner unit 18 scans laser beams from the laser emitting unit (not shown) by the polygon mirror according to image signals, leads them to the optical path via several optical lenses (not shown) with the reflecting mirrors 24, and irradiates them on the photosensitive drums 1.

Rotation of the photosensitive drums 1 in synchronization with image signals read by the reader unit 17 causes the scanned laser beams from the laser scanner unit 18 to form a latent image on the photosensitive drums 1 (Step 806).

The latent images formed on the photosensitive drums 1 are visualized (development) using toner by the developing unit 3 being developing means. The visualized images are transferred to the intermediate transfer belt 9 being an endless belt by the transfer roller 8 (Step 807).

In the monochrome mode, the above operation is conducted only for black. In the six color mode, the above processes are repeated continuously for each of the colors; light magenta, light cyan, yellow, cyan, magenta and black. In the four color mode, the above processes are repeated continuously for each of the colors; yellow, cyan, magenta and black. According as the intermediate transfer belt 9 moves in the direction of the arrow Z with a process speed kept, toner images for each color are sequentially and superimposedly transferred to the intermediate transfer belt 9.

A transferring sheet (not shown) being a transferring material is loaded onto the feeding cassette 26. The transferring sheet is picked up by the feeding roller 25 and conveyed along a transferring sheet conveying path 22 by a plurality of conveying rollers (not shown). The toner images for each color transferred to the intermediate transfer belt 9 are transferred to the transferring sheet in the nip between the transfer driving roller 10 and the outer transfer roller 13 (Step 808). After that, the fixing unit 19 applies heat and pressure to the toner images for each color to fix them on the transferring sheet and then the sheet is ejected.

When transfer of toner images to the transfer sheet has been finished (Step 809), the intermediate transfer belt 9 is always moved to the six color mode (Step 810). That is to say, when images have been formed in the four color and the monochrome mode, the intermediate transfer belt 9 is moved to come in contact with photosensitive drums 1.

Toner left on the photosensitive drums 1 is collected with cleaning units 2 to clean the photosensitive drums 1. Toner left on the intermediate transfer belt 9 is collected with the intermediate transfer belt cleaner 27 to clean the intermediate transfer belt 9. At the point when cleaning of the intermediate transfer belt 9 has been completed a printing job terminates (Step 811).

This application claims priority from Japanese Patent Application No. 2004-358013 filed Dec. 10, 2004, which is hereby incorporated by-reference herein.

What is claimed is:

1. An image forming apparatus comprising:

a plurality of image bearing members for bearing toner images;

an intermediate transfer belt to which the toner images on the image bearing members are transferred;

contacting and separating means for causing the image bearing members to be in contact with and separated from the intermediate transfer belt;

a first image forming mode where one of the plurality of image bearing members is in contact with the intermediate transfer belt and where toner images on the image bearing members are transferred to the intermediate transfer belt;

a second image forming mode where the plurality of image bearing members are in contact with the intermediate transfer belt and where toner images on the image bearing members are superimposedly transferred to toner images on the intermediate transfer belt;

switching means for causing the image bearing members to be into contact with and separated from the intermediate transfer belt to switch the image forming modes; and bias controlling means for controlling the bias of the intermediate transfer belt by rotating the intermediate transfer belt until the toner images on the image bearing members are transferred to the intermediate transfer belt after the image bearing members have been caused to be in contact with or separated from the intermediate transfer belt, wherein a duration when the intermediate transfer belt is rotated by the bias controlling means when the second image forming mode is changed to the first image forming mode is shorter than a duration when the intermediate transfer belt is rotated by the bias controlling means when the first image forming mode is changed to the second image forming mode.

2. The image forming apparatus according to claim 1, further comprising:

removing means for removing toner from the intermediate transfer belt, wherein bias control by the bias controlling means is conducted within the period when the removing means removes the toner.

3. The image forming apparatus according to claim 2, further comprising:

electrostatic image forming means comprising a rotating polygon for reflecting light beams from a plurality of surfaces thereof and driving source for rotating the rotating polygon, and forming electrostatic images on the image bearing members; and toner image forming means for developing the electrostatic image and forming toner image, wherein bias control by the bias controlling means is conducted within the period when the rotating polygon rotates.

4. An image forming apparatus comprising:

a plurality of image bearing members for bearing toner images;

a transfer material conveying belt for conveying transfer material;

transferring means for transferring the toner images on the image bearing members to the transfer material;

contacting and separating means for causing the image bearing members to be in contact with and separated from the transfer material conveying belt;

a first image forming mode where one of the plurality of image bearing members is in contact with the transfer material conveying belt and where the toner images on the image bearing members are transferred to the transfer material conveyed by the transfer material conveying belt;

a second image forming mode where the plurality of image bearing members are in contact with the transfer material conveying belt and where the toner images on the image bearing members are superimposedly transferred to the toner images on the transfer material;

switching means for causing the image bearing members to be in contact with and separated from a recording material conveying member to switch the image forming modes;

bias controlling means for controlling the bias of the transfer material conveying belt by rotating the transfer material conveying belt until the toner images on the image bearing members are transferred to the transfer material after the image bearing members have been caused to be in contact with or separated from the transfer material conveying belt, wherein a duration when the transfer material conveying belt is rotated by the bias controlling means when the second image forming mode is changed to the first image forming mode is shorter than a duration when the transfer material conveying belt is rotated by the bias controlling means when the first image forming mode is changed to the second image forming mode.

5. The image forming apparatus according to claim 4, further comprising:

removing means for removing toner from the transfer material conveying belt, wherein bias control by the bias controlling means is conducted within the period when the removing means removes the toner.

6. The image forming apparatus according to claim 5, further comprising:

electrostatic image forming means comprising a rotating polygon for reflecting light beams from a plurality of surfaces thereof and driving source for rotating the rotating polygon, and forming electrostatic images on the image bearing members; and toner image forming means for developing the electrostatic image and forming toner image, wherein bias control by the bias controlling means is conducted within the period when the rotating polygon rotates.

* * * * *

UNITED STATES PATENT AND TRADEMARK OFFICE

CERTIFICATE OF CORRECTION

PATENT NO. : 7,343,125 B2
APPLICATION NO. : 11/296281
DATED : March 11, 2008
INVENTOR(S) : Kazunori Miyake It is certified that error appears in the above-identified patent and that said Letters Patent is hereby corrected as shown below:

ON THE TITLE PAGE:
At Item (57), ABSTRACT, Line 2, “a toner” should read --toner--.

COLUMN 1:
Line 23, “members-on” should read --members on--.

COLUMN 2:
Line 16, “into contact” should read --in contact--.

COLUMN 3:
Line 18, “monochrome” should read --monochrome mode--.

COLUMN 4:
Line 8, “a reflecting” should read --reflecting--.
Line 11, “has-a” should read --has a--.
Line 62, “720 mm. The” should read --720 mm, the--.

COLUMN 5:
Line 7, “touch” should read --touches--.
Line 66, “According as” should read --Accordingly as--.

COLUMN 6:
Line 23, “being” should be deleted.
Line 24, “into” should read --in--.

COLUMN 7:
Line 55, “images has” should read --images have--.

COLUMN 8:
Line 24, “color images has” should read --monochrome images have--.
Line 25, “color” should be deleted.
Line 55, “images has” should read --images have--.

COLUMN 9:
Line 26, “drum. 1K” should read --drum 1K--.

UNITED STATES PATENT AND TRADEMARK OFFICE

CERTIFICATE OF CORRECTION

PATENT NO. : 7,343,125 B2
APPLICATION NO. : 11/296281
DATED : March 11, 2008
INVENTOR(S) : Kazunori Miyake It is certified that error appears in the above-identified patent and that said Letters Patent is hereby corrected as shown below:

COLUMN 11:

Line 26, “colors;” should read --colors:--.
Line 29, “colors;” should read --colors:--.
Line 30, “According as” should read --Accordingly as--.
Line 61, “by-reference” should read --by reference--.

Signed and Sealed this

Sixteenth Day of September, 2008

JON W. DUDAS
*Director of the United States Patent and Trademark Office*